US006613821B2

(12) United States Patent
Suzuki et al.

(10) Patent No.: US 6,613,821 B2
(45) Date of Patent: Sep. 2, 2003

(54) CLOTH TREATING AGENT, CLOTH, TEXTILE PRINTING PROCESS AND PRINT

(75) Inventors: Mariko Suzuki, Yokohama (JP); Shoji Koike, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/411,395

(22) Filed: Oct. 4, 1999

(65) Prior Publication Data

US 2003/0013367 A1 Jan. 16, 2003

(30) Foreign Application Priority Data

Oct. 9, 1998 (JP) ..... 10-288160

(51) Int. Cl.[7] ..... C08K 5/15

(52) U.S. Cl. ..... 524/111; 428/413; 442/156; 442/175; 442/119; 8/445

(58) Field of Search ..... 524/111; 428/413; 442/156, 175, 119; 8/445

(56) References Cited

U.S. PATENT DOCUMENTS 3,619,271 A * 11/1971 Therwil et al.
3,769,060 A * 10/1973 Ida et al.
5,645,631 A 7/1997 Koike et al. ..... 106/31.36
5,695,689 A * 12/1997 Gupta et al.
5,781,216 A 7/1998 Haruta et al. ..... 347/106
5,871,669 A * 2/1999 Tittmann et al.

FOREIGN PATENT DOCUMENTS

| | | |
|---|---|---|
| EP | 0 229 652 A2 | 7/1987 |
| EP | 0 790 347 A2 | 8/1997 |
| JP | 54-59936 | 5/1979 |
| JP | 61-55277 | 3/1986 |
| JP | 63-168382 | 7/1988 |
| JP | 9-279490 | 10/1997 |
| WO | WO 93/11865 | 6/1993 |
| WO | WO 95/11936 | 5/1995 |

OTHER PUBLICATIONS

Database WPI, Section Ch, Week 197906, Derwent Publications Ltd., Class A96, AN 1979–10883B, XP–002182348, with respect to JP 53–148546 of Dec. 25, 1978.

* cited by examiner

*Primary Examiner*—Rachel Gorr
(74) *Attorney, Agent, or Firm*—Fitzpatrick, Cella, Harper & Scinto

(57) ABSTRACT

Disclosed herein is a cloth treating agent comprising a tocopherol and at least one of a polyethylene oxide compound and a derivative thereof. The cloth treating agent permits the provision of a print which has sufficiently high color value and depth in color and can be prevented to the utmost from undergoing bleeding even when the amount of inks applied is great.

3 Claims, 3 Drawing Sheets

CLOTH TREATING AGENT, CLOTH, TEXTILE PRINTING PROCESS AND PRINT

BACKGROUND OF THE INVENTION

1. Field of the Invention

The present invention relates to a cloth treating agent, a cloth and a textile printing process, which are suitable for use in printing using an ink-jet system, and to a print.

2. Related Background Art

As processes for conducting ink-jet textile printing on a cloth, there have heretofore been a process in which a cloth pretreated with an aqueous solution containing any of a water-soluble polymeric substance, a water-soluble salt and water-insoluble inorganic fine particles, which all have a non-dyeing property with respect to dyes used, is printed by an ink-jet system (Japanese Patent Publication No. 63-31594; corresponding to Japanese Patent Application Laid-Open No. 61-55277), a process in which cellulose fiber is pretreated with a solution containing an alkaline substance, urea or thiourea and a water-soluble polymer, printed with inks containing a reactive dye by an ink-jet system and then subjected to a fixing treatment under dry heat (Japanese Patent Publication No. 4-35351; corresponding to Japanese Patent Application Laid-Open No. 63-168382), etc. Besides, the present inventors proposed a process in which inks are applied to a cloth, to which a water repellent and a polyethylene oxide resin have been attached, by an ink-jet system, and the cloth is subjected to a coloring treatment, washed and then dried (Japanese Patent Application Laid-Open No. 9-279490).

Objects of these prior art processes are to prevent bleeding of an image formed on a cloth and to provide a bright print having a sharp pattern and high color value.

SUMMARY OF THE INVENTION

The present inventors have carried out an additional investigation as to these prior art processes, and paid attention to the stable provision of a print satisfying the above objects when various conditions in a textile printing process, i.e. from the cloth treating step up to the coloring step, fluctuate, for example, when the time from the cloth treating step up to the coloring step is long. As a result, it has been found that molecular chains of a polyethylene oxide compound and a derivative thereof, which are cloth treating agents useful for the prevention of bleeding and the formation of an image having a high color value, are severed, as their nature, by the influence of temperature, metal, oxidizing agent, pH, physical external force, air, light, etc., and their performance may be deteriorated in some cases. The present inventors have therefore concluded that some improvement is required to handle these cloth treating agents for the purpose of providing a higher-quality print by an ink-jet system.

It is therefore an object of the present invention to provide a cloth treating agent for ink-jet textile printing, which permits the provision of a print which has sufficiently high color value and depth in color, even when coloring conditions fluctuate, or even after the cloth treating agent, an aqueous solution thereof or a cloth treated with such an aqueous solution is stored for a long period of time, and can be prevented to the utmost from undergoing bleeding even when the amount of inks applied is great.

Another object of the present invention is to provide a cloth which permits the stable provision of a high-quality print even when it is left to stand for a long period of time in various environments.

A further object of the present invention is to provide a textile printing process which permits the stable provision of an excellent print.

A still further object of the present invention is to provide a print of even quality.

The present inventors have repeatedly carried out investigations with a view toward achieving the above-described objects. As a result, it has been found that tocopherols specifically act on improvement in the storage stability of a polyoxyethylene oxide compound or a derivative thereof as a cloth treating agent, thus leading to completion of the present invention.

The above objects can be achieved by the present invention described below.

According to a first aspect of the present invention, there is thus provided a cloth treating agent comprising a tocopherol and at least one of a polyethylene oxide compound and a derivative thereof.

According to another aspect of the present invention, there is also provided a cloth comprising a tocopherol and at least one of a polyethylene oxide compound and a derivative thereof.

According to further aspect of the present invention, there is further provided a textile printing process comprising the steps of:

(i) applying an ink to a cloth comprising a tocopherol and at least one of a polyethylene oxide compound and a derivative thereof using an ink-jet system;

(ii) subjecting the cloth, to which the ink has been applied, to a coloring treatment; and (iii) washing and drying the cloth resulting from step (ii).

According to a still further aspect of the present invention, there is still further provided a print produced in accordance with a textile printing process comprising the steps of:

(i) applying an ink to a cloth comprising a tocopherol and at least one of a polyethylene oxide compound and a derivative thereof using an ink-jet system;

(ii) subjecting the cloth, to which the ink has been applied, to a coloring treatment; and (iii) washing and drying the cloth resulting from step (ii).

DESCRIPTION OF THE PREFERRED EMBODIMENTS

Figure 1:
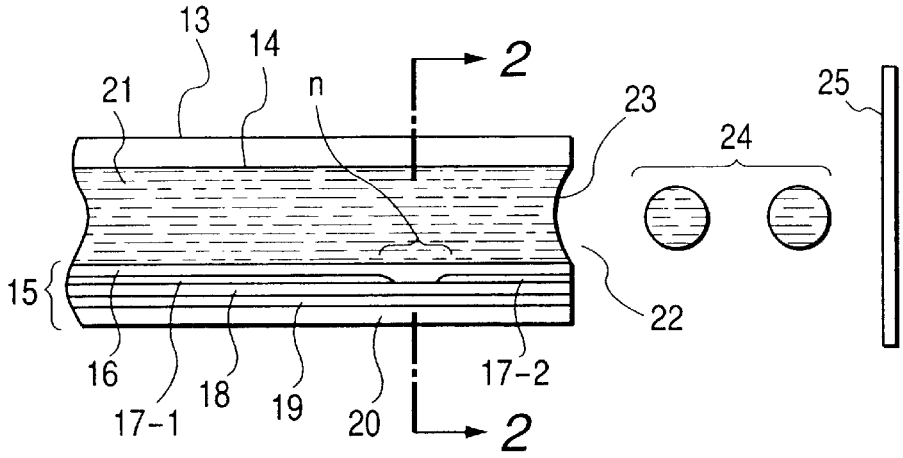
FIG. 1 is a longitudinal cross-sectional view of a head of an ink-jet printing apparatus.

The present invention will hereinafter be described in more detail by preferred embodiments of the present invention.

The use of the cloth treating agent for ink-jet textile printing according to the present invention permits the provision of an ink-jet printed cloth which has sufficiently high color value and deep color even when conditions of coloring in ink-jet textile printing fluctuate, or even after the cloth treating agent, an aqueous solution thereof or a cloth treated with such an aqueous solution is stored for a long period of time, and can be prevented to the utmost from undergoing bleeding even when the amount of an ink applied is large.

The polyethylene oxide compounds useful in the practice of the present invention are generally ring-opening polymers of ethylene oxide, and no particular limitation is imposed on them. However, those preferably used in the present invention are polymers having a weight average molecular weight of about 100,000 to 2,000,000. When the molecular weight falls within this range, the resulting treatment solution is prevented from increasing its viscosity to a too high extent, and the ink-retaining ability and bleeding-preventing effect thereof upon textile printing can be fully ensured.

No particular limitation is also imposed on the derivatives of the polyethylene oxide compounds. However, examples thereof include polyethylene glycols, polyethylene oxide alkyl ethers, polyoxyethylene alkyl-phenyl ethers, polyoxyethylene fatty acid esters and polyoxyethylene sorbitan fatty acid esters. Of these, those in which the number of moles of ethylene oxide added is about 25 to 80 are preferred.

No particular limitation is also imposed on the tocopherols useful in the practice of the present invention. However, examples thereof include α-tocopherol, β-tocopherol, γ-tocopherol and δ-tocopherol. In the present invention, γ-tocopherol and δ-tocopherol are particularly preferably used. The above-mentioned tocopherols may be used in any combination thereof.

The polyoxyethylene compounds and/or the derivatives thereof have effects of retaining a dye in an ink on the surface of a cloth to enhance the coloring ability of the ink and preventing bleeding. When such a compound or a derivative thereof is impregnated into or applied to a cloth and the time goes on, however, in the meantime, its molecular chain is severed by the influence of temperature, metal, oxidizing agent, pH, physical external force, air, light, etc. as described above, and its excellent performance as a cloth treating agent may be deteriorated in some cases. The tocopherols can extremely effectively prevent the deterioration of the polyethylene oxide compounds and the derivatives thereof. The reason for it is not clearly known. However, it seems that when a polyethylene oxide compound or a derivative thereof is used in combination with a tocopherol, the tocopherol incurs the attack of such environments as described above, for example, temperature, against the polyethylene oxide compound or the derivative thereof instead, and the direct attack against the polyethylene oxide compound or the derivative thereof is lessened, and so the molecular chain of the polyoxyethylene oxide compound or the like is not severed, and the deterioration of performance in such a compound can be prevented.

A preferred proportion of the tocopherol used is within a range of from 0.01 to 20% by weight, preferably from 0.1 to 15% by weight, more preferably from 0.5 to 10% by weight based on the polyethylene oxide compound and/or the derivative thereof. If the proportion of the tocopherol is lower than 0.01% by weight, the effects of the present invention cannot be achieved. If the proportion of the tocopherol is higher than 20% by weight, on the other hand, the prevention of scission of the molecular chain of the polyethylene oxide compound or the like is not further enhanced, but, rather, the coloring ability of a dye in an ink is deteriorated, and the fastness properties of the resulting print may be lowered in some cases.

The above components are essential components of the cloth treating agent according to the present invention. When an amino acid and a water-soluble salt are used in combination with the above components, better effects may be exhibited in some cases. No particular limitation is imposed on the amino acid used in the present invention. However, DL-alanine is particularly preferred, among others. The use of the amino acid is not essential. A preferable amount, if used, is 0.001 to 10% by weight based on the polyethylene oxide compound and/or the derivative thereof.

No particular limitation is also imposed on the water-soluble salts used in the present invention. However, examples thereof include ammonium salts such as ammonium sulfate, inorganic metal salts such as potassium sulfate, sodium sulfate, sodium chloride and sodium bromide, and organic acid salts such as sodium citrate, potassium succinate, sodium acetate and sodium malonate. The use of these water-soluble salts is not essential. A preferable amount, if used, is 5:1 to 1:20 in terms of the weight ratio of the water-soluble salts to the polyethylene oxide compound and/or the derivative thereof.

The content of at least one of the polyethylene oxide compound and the derivative thereof, and the tocopherol is 0.1 to 30% by weight, particularly 0.3 to 20% by weight based on the dry weight of the cloth used. The cloth treating agent according to the present invention may be applied to a cloth by any means. Such processes include a process in which at least one of the polyethylene oxide compound and the derivative thereof, and the tocopherol are applied to a cloth as an aqueous solution containing them in an amount of 1 to 20% by weight, preferably 1.5 to 15% by weight, and the cloth is then dried. A preferred drying method is a pad dry method in which a drying treatment is conducted at 140° C. or lower, particularly 120° C. or lower.

Food materials such as quillaia extract, xanthan gum, gum arabic, ethanol, vegetable oil and dextrin may be contained in a pretreatment solution to uniformly impregnate a cloth with the cloth treating agent according to the present invention. In addition, a hydrotropic agent, a chelating agent and the like may be added to the pretreatment solution to improve a bleed-preventing effect when ink-jet textile printing is conducted.

Any cloth may be used as a cloth for ink-jet textile printing according to the present invention. However, preferable examples thereof include cloths separately made of cotton, silk, hemp, rayon, acetate, nylon and polyester. The cloth used may be a blended cloth made of two or more of these fibers. In particular, the present invention is effective for a cloth made of a nylon or polyester fiber, or a blended cloth made of two or more of these fibers.

The textile printing process of the present invention, in which the cloth for ink-jet textile printing according to the present invention is used to conduct ink-jet printing on the cloth, will hereinafter be described.

In the textile printing according to the present invention, inks containing the most suitable dye according to the above-described various cloths may preferably be used. Examples of a coloring material in inks usable in the present invention include reactive dyes, acid dyes, direct dyes, disperse dyes and pigments.

The inks contain, as components of the inks, at least water or a mixed solvent comprising water and a water-soluble organic solvent in addition to these dyes, and may suitably contain various kinds of additives such as pH adjustors, mildewproofing agents, surfactants and water-soluble resins. Examples of the water-soluble organic solvent include glycols, glycol ethers and nitrogen-containing solvents. As the surfactants, nonionic, anionic, cationic and amphoteric surfactants may be used. These surfactants are each properly used as necessary for the end application intended.

A dispersing agent is essential to inks containing a disperse dye. As specific examples thereof, lignin sulfonates, naphthalenesulfonic acid-formalin condensates and polyoxyethylene alkyl phenyl ethers may be mentioned.

In the textile printing process according to the present invention, an image is formed with such inks as described above on the above-described cloth for ink-jet textile printing according to the present invention by an ink-jet system. At this time, an ink-jet printing head is scanned on the cloth to apply the inks to desired positions of the cloth, thereby forming an image. After the ink-jet printing, the cloth is subjected to a coloring treatment as needed, washed and then dried, thereby providing the intended print. As the coloring treatment, any conventionally-known technique such as a heating and coloring treatment performed in the conventional textile printing process may be suitably used as it is. Namely a high-temperature steaming process or thermosol process is used.

The ink-jet printing system used in the present invention may be any conventionally-known ink-jet recording system. However, the method described in Japanese Patent Application Laid-Open No. 54-59936, i.e., a system in which thermal energy is applied to an ink so as to undergo a rapid volume change, and the ink is ejected from a nozzle by action force caused by this change of state, is most effective. The reason for it is that when a printing head having a plurality of nozzles is used, the above system can make a scatter of ejection velocities of inks among the nozzles narrow, and so the ejection velocities of the inks can be focused within a range of from 5 to 20 m/sec. When an ink strikes a cloth at a velocity within this range, the state of penetration of ink droplets into fibers of a cloth becomes optimum at the time the ink droplets have been applied to the cloth.

As conditions under which a printing process having a particularly high effect can be attained, it is preferred that an ejected ink droplet be within a range of from 5 to 200 pl, a shot-in ink quantity be within a range of from 4 to 40 nl/mm$^2$, a drive frequency be at least 1.5 kHz, and a head temperature be within a range of from 35 to 60° C.

An example of an apparatus suitable for use in performing the ink-jet textile printing in the present invention is an apparatus in which thermal energy in response to a printing signal is applied to an ink within a liquid chamber of a printing head, and an ink droplet is generated by the thermal energy. Such an apparatus will hereinafter be described. Examples of the construction of the head, which is a main component of the apparatus, are illustrated in FIGS. 1, 2 and 3.

A head 13 is formed by bonding a glass, ceramic, plastic plate or the like having a groove 14 through which an ink is passed, to a heating head 15 used in thermal recording (the drawings show a head to which, however, the invention is not limited). The heating head 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property.

An ink 21 comes up to an ejection orifice (a minute opening) 22 and forms a meniscus 23 due to a pressure P. Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the ejection orifice 22 to a cloth 25 in the form of ink droplets 24.

Figure 2:
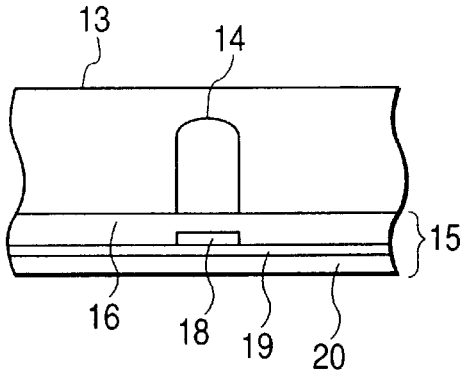
FIG. 2 is a transverse cross-sectional view of the head of the ink-jet printing apparatus.
Figure 3:
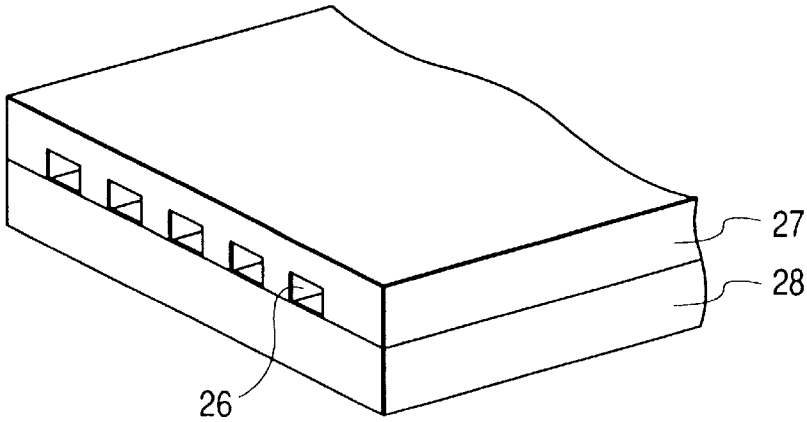
FIG. 3 is a perspective view of the appearance of a multi-head which is an array of such heads as shown in FIG. 1.

In FIG. 2, reference numerals have the same meaning as in FIG. 1.

FIG. 3 illustrates an appearance of a multi-head composed of an array of a number of heads as shown in FIG. 1. The multi-head is formed by closely bonding a glass plate 27 having a number of grooves 26 to a heating head 28 similar to the heating head illustrated in FIG. 1. Incidentally, FIG. 1 is a cross-sectional view of a head taken along a flow path of the ink, and FIG. 2 is a cross-sectional view taken along line 2—2 in FIG. 1.

Figure 4:
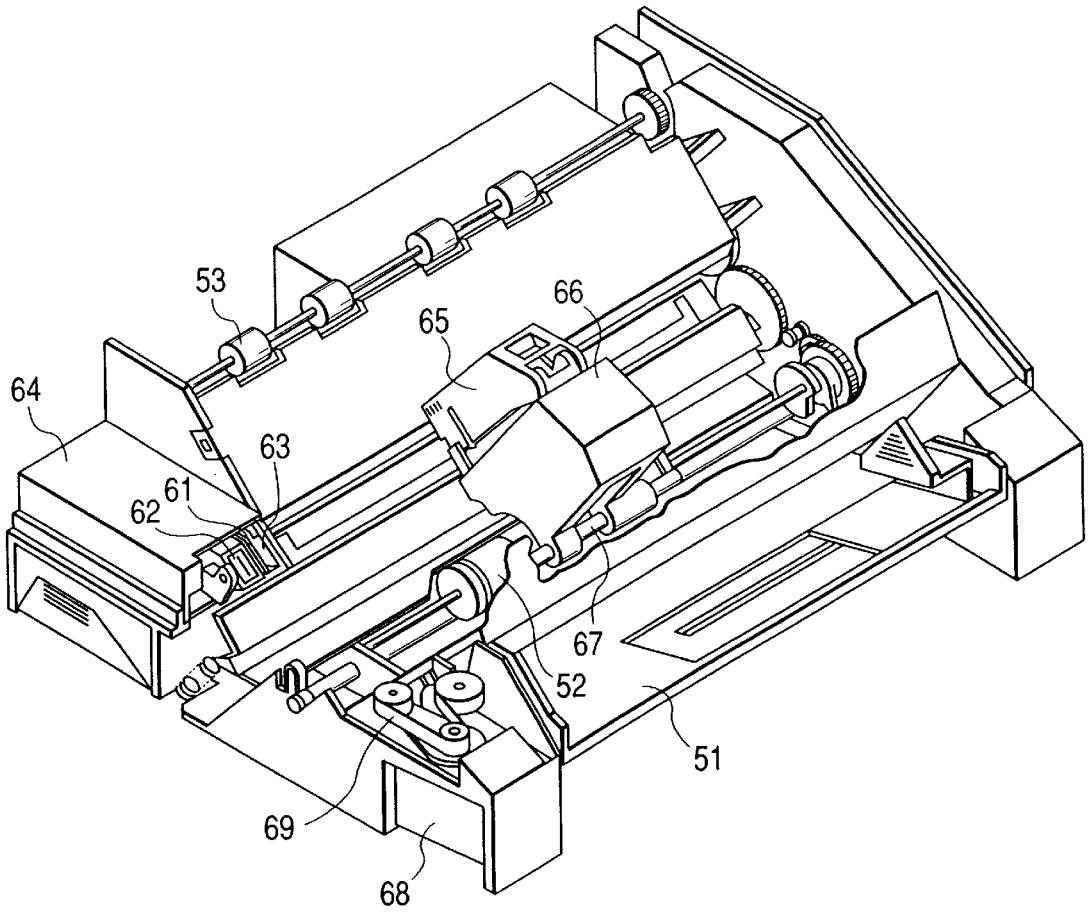
FIG. 4 is a perspective view of an illustrative ink-jet printing apparatus.

FIG. 4 illustrates an example of an ink-jet printing apparatus in which the above head has been incorporated. In FIG. 4, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes into the course through which the printing head is moved.

Reference numeral 62 indicates a cap, which is provided at the home position adjacent to the blade 61, and is so constituted that it moves in the direction perpendicular to the direction in which the printing head 65 is moved and comes into contact with the face of ejection openings to cap it. Reference numeral 63 denotes an absorbing member provided adjoiningly to the blade 61 and, similar to the blade 61, held in such a form that it protrudes into the course through which the printing head 65 is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates a printing head having an ejection-energy-generating means and serving to eject the ink onto the cloth set in an opposing relation to the ejection opening face provided with ejection openings to conduct printing. Reference numeral 66 indicates a carriage on which the printing head 65 is mounted so that the printing head 65 can be moved. The carriage 66 is slidably interlocked with a guide rod 67 and is connected (not illustrated) to a belt 69 driven by a motor 68. Thus, the carriage 66 can be moved along the guide rod 67 and hence, the printing head 65 can be moved from a printing region to a region adjacent thereto.

Reference numerals 51 and 52 denote a cloth feeding part from which cloths are separately inserted, and cloth feed rollers driven by a motor (not illustrated), respectively. With such a construction, the cloth is fed to the position opposite to the ejection opening face of the printing head 65, and discharged from a cloth discharge section provided with cloth discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement. The above movement of the printing head 65 to its home position is made not only when the printing is completed or the printing head 65 is recovered for ejection, but also when the printing head 65 is moved between printing regions for the purpose of printing, during which it is moved to the home position adjacent to each printing region at given intervals, where the ejection opening face is wiped in accordance with this movement.

Figure 5:
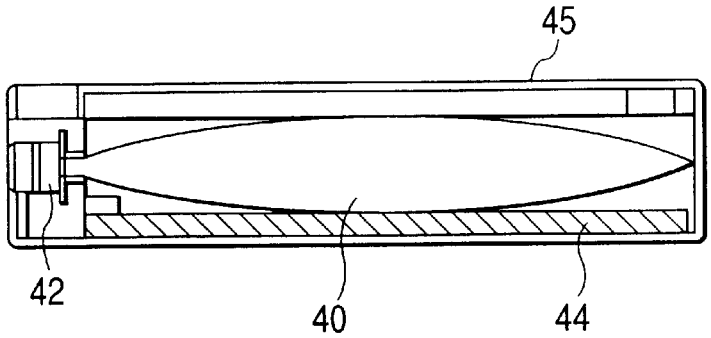
FIG. 5 is a longitudinal cross-sectional view of an ink cartridge.

FIG. 5 illustrates an exemplary ink cartridge 45 in which an ink to be fed to the head through an ink-feeding member, for example, a tube is contained. Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink. It is preferred that the ink container portion be formed of a polyolefin, in particular, polyethylene, at its surface with which the ink comes into contact. The ink-jet printing apparatus used in the present invention are not limited to the apparatus as described above in which the head and the ink cartridge are separately provided. Therefore, a device in which these members are integrally formed as shown in FIG. 6 can also be preferably used.

Figure 6:
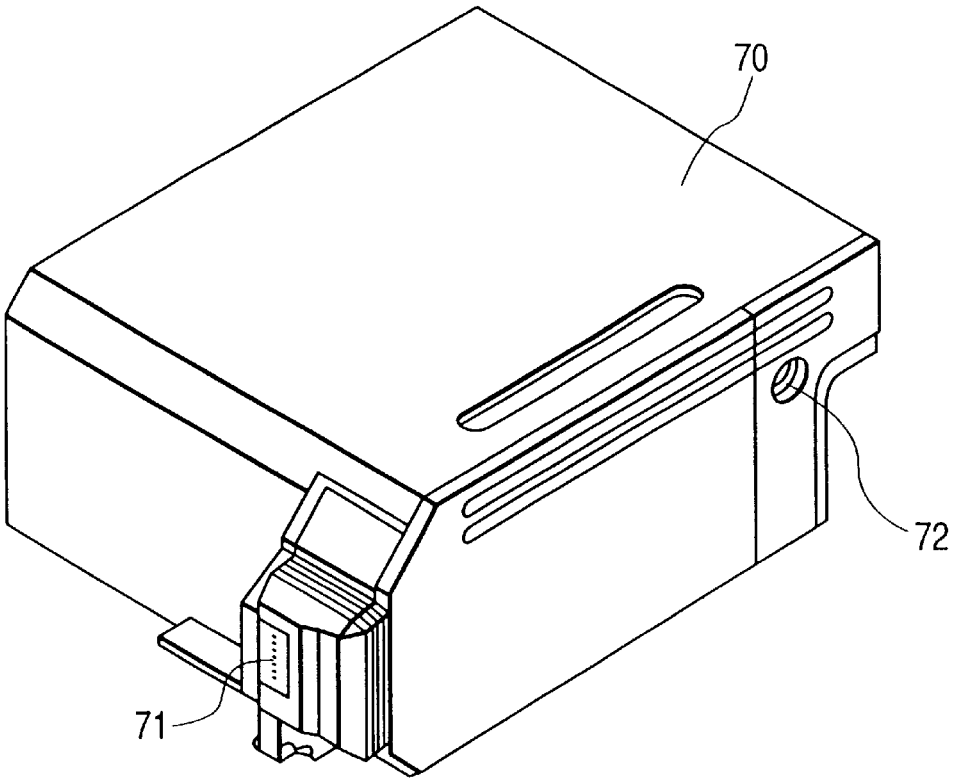
FIG. 6 is a perspective view of an illustrative printing unit.

In FIG. 6, reference numeral 70 designates a printing unit, in the interior of which an ink container portion containing an ink, for example, an ink-absorbing member, is contained. The printing unit 70 is so constructed that the ink in such an ink-absorbing member is ejected in the form of ink droplets through a head 71 having a plurality of orifices. Reference numeral 72 indicates an air passage for communicating the interior of the printing unit 70 with the atmosphere. This printing unit 70 can be used in place of the printing head 65 shown in FIG. 4, and is detachably installed on the carriage 66.

According to the present invention, as described above, images which are bright, deep in color, and even and high in color value can be stably formed over a long period of time.

According to the present invention, bright prints composed respectively of various kinds of fibers and having depth in color and a high color value can also be easily provided by ordinary ink-jet printers coming into the market for office and personal uses.

The present invention will hereinafter be described more specifically by the following Examples and Comparative Examples. However, the present invention is not limited to these examples. Incidentally, all designations of "part" or "parts" and "%" as will be used in the following examples mean part or parts by weight and % by weight unless expressly noted.

EXAMPLE 1-1

Twenty percent (20%) of a polyethylene oxide compound (Alkox E-30, trade name, product of Meisei Chemical Works, Ltd.; molecular weight: 300,000 to 500,000) was mixed with 79.5% of sodium sulfate and 0.5% of δ-tocopherol to obtain a first cloth treating agent for ink-jet textile printing. A second cloth treating agent was then prepared by thoroughly mixing 10% of the first cloth treating agent with 90% of water. A polyester cloth was impregnated with the second cloth treating agent at a pickup of 100% and then dried at 100° C. for 1 minute by a pin tenter to obtain a cloth for ink-jet textile printing.

The thus-obtained cloth was cut into sizes of an A4 format, and full-color printing was conducted on the cloth sample thus obtained by means of a commercially available ink-jet color printer (BJC-820J, trade name, manufactured by Canon Inc.) using inks prepared by mixing and dispersing the following respective components by means of a sand grinder and filtering the dispersions through a filter.

| | |
|---|---|
| Yellow ink: | |
| C.I. Disperse Yellow 93 | 5 parts |
| Sodium lignin sulfonate | 3 parts |
| Thiodiglycol | 10 parts |
| Triethylene glycol | 15 parts |
| Ion-exchanged water | 67 parts. |
| Magenta ink: | |
| C.I. Disperse Red 92 | 5 parts |
| Sodium lignin sulfonate | 3 parts |
| Thiodiglycol | 10 parts |
| Triethylene glycol | 15 parts |
| Ion-exchanged water | 67 parts. |
| Cyan ink: | |
| C.I. Disperse Blue 87 | 6 parts |
| Sodium lignin sulfonate | 3 parts |
| Thiodiglycol | 10 parts |
| Triethylene glycol | 15 parts |
| Ion-exchanged water | 66 parts. |
| Black ink: | |
| C.I. Disperse Black 1 | 7 parts |
| Sodium lignin sulfonate | 3 parts |
| Thiodiglycol | 10 parts |
| Triethylene glycol | 15 parts |
| Ion-exchanged water | 65 parts. |

After completion of the printing, the printed cloth was immediately subjected to a steaming treatment at 180° C. for 8 minutes and to reduction cleaning by a method known per se in the art, thoroughly washed with water and then dried. As a result, a color image having deep color and a sufficient color value was brightly printed on the resultant polyester cloth. In addition, the print thus obtained was free of any bleeding of the image even at its portions of large shot-in ink quantity.

EXAMPLE 1-2

After the first cloth treating agent set forth in Example 1-1 was stored for 50 days at ordinary temperature and humidity, a second cloth treating agent was prepared in the same manner as described above. A polyester cloth was treated with this second cloth treating agent, thereby evaluating the cloth in the same manner as described above. As a result, the deterioration of image by the storage of the first cloth treating agent was not observed, and a color image having deep color and a sufficient color value was brightly printed on the resultant polyester cloth. In addition, the print thus obtained was free of any bleeding of the image even at its portions of large shot-in ink quantity.

EXAMPLE 1-3

The second cloth treating agent set forth in Example 1-1 was stored for 20 days at ordinary temperature and humidity. A polyester cloth was treated with the second cloth treating agent thus stored in the same manner as described above, thereby evaluating the cloth in the same manner as described above. As a result, the deterioration of image by the storage of the second cloth treating agent was not observed, and a color image having deep color and a sufficient color value was brightly printed on the resultant polyester cloth. In addition, the print thus obtained was free of any bleeding of the image even at its portions of large shot-in ink quantity.

EXAMPLE 1-4

A polyester cloth was treated with the second cloth treating agent set forth in Example 1-1 in the same manner as in Example 1-1. The polyester cloth was stored for 20 days at ordinary temperature and humidity and then evaluated in the same manner as described above. As a result, the deterioration of image by the storage of the treated cloth was not observed, and a color image having deep color and a sufficient color value was brightly printed on the resultant polyester cloth. In addition, the print thus obtained was free of any bleeding of the image even at its portions of large shot-in ink quantity.

The above-described results are shown in Table 1.

TABLE 1

| | | Proportion of tocopherol to polyethylene oxide | Evaluation* results |
|---|---|---|---|
| Initial image | Ex. 1-1 | 2.5% | A |
| Storage stability | Ex. 1-2 | " | A |
| | Ex. 1-3 | " | A |
| | Ex. 1-4 | " | A |

* Evaluation of initial image (Example 1-1):
The initial image was ranked as A to D with the criteria as follows:
A: Particularly good;
B: Good;
C: Caused some problem;
D: Unacceptable.
* Evaluation of storage stability:
The storage stability was ranked as A to C with the criteria as follows:
A: Reduction in K/S value at the maximum adsorption wavelength was less than 2 compared with the initial image, and the ocurrence of bleeding was also equivlaient to that of the initial image;
B: Reduction in K/S value at the maximum adsorption wavelength was not less than 2 but less than 4 compared with the initial image, and the bleeding was somewhat greater than that of the initial image; and
C: Reduction in K/S value at the maximum adsorption wavelength was not less than 4 compared with the initial image, and the bleeding was considerably greater than that of the initial image.

EXAMPLES 2-1 to 2-4

Fifty percent (50%) of polyoxyethylene (n=50) cetyl ether (molecular weight: 2,500) was mixed with 0.1% of γ-tocopherol, 0.15% of δ-tocopherol, 15% of ammonium sulfate and 34.75% of urea to obtain a first cloth treating agent. A second cloth treating agent was then prepared by thoroughly mixing 15% of the first cloth treating agent with 85% of water. A nylon cloth was impregnated with the second cloth treating agent at a pickup of 100% and then dried at 80° C. for 1 minute by a pin tenter to obtain a cloth for ink-jet textile printing according to this example.

The thus-obtained cloth was cut into sizes of an A4 format, and full-color printing was conducted on the cloth sample thus obtained by means of a commercially available ink-jet color printer (BJC-620, trade name, manufactured by Canon Inc.) using 4 kinds of inks having the following respective compositions. The four kinds of inks used were prepared by mixing and stirring the respective components, adjusting the resultant mixtures to pH 8 with sodium hydroxide and then filtering them through a Fluoropore filter.

| | |
|---|---|
| Yellow ink: | |
| C.I. Acid Yellow 135 | 3 parts |
| C.I. Direct Yellow 86 | 2 parts |
| Thiodiglycol | 24 parts |
| Diethylene glycol | 11 parts |
| Ion-exchanged water | 60 parts. |
| Magenta ink: | |
| C.I. Acid Red 226 | 7 parts |
| Thiodiglycol | 15 parts |
| Diethylene glycol | 10 parts |
| Ion-exchanged water | 68 parts. |
| Cyan ink: | |
| C.I. Acid Blue 185 | 9 parts |
| Thiodiglycol | 20 parts |
| Diethylene glycol | 15 parts |
| Ion-exchanged water | 56 parts. |
| Black ink: | |
| C.I. Acid Brown 13 | 2 parts |
| C.I. Acid Orange 156 | 1.5 parts |
| C.I. Acid Blue 205 | 6.5 parts |
| Thiodiglycol | 25 parts |
| Triethylene glycol | 10 parts |
| Ion-exchanged water | 55 parts. |

After completion of the printing, the printed cloth was immediately subjected to a steaming treatment at 100° C. for 30 minutes, washed with water and then dried. As a result, a color image having deep color and a sufficient color value was brightly printed on the resultant nylon cloth. In addition, the print thus obtained was free of any bleeding of the image even at its portions of large shot-in ink quantity. Further, the first cloth treating agent, the second cloth treating agent and the cloth treated with the second cloth treating agent were respectively stored in the same manner as in Examples 1-2 to 1-4 and evaluated. As a result, no deterioration by the storage was observed in any case.

The above-described results are shown in Table 2.

TABLE 2

| | | Proportion of tocopherol to polyethylene oxide | Evaluation* results |
|---|---|---|---|
| Initial image | Ex. 2-1 | 0.5% | A |
| Storage stability | Ex. 2-2 | " | A |
| | Ex. 2-3 | " | A |
| | Ex. 2-4 | " | A |

EXAMPLES 3-1 to 3-4

Eight percent (8%) of a polyethylene oxide compound (Alkox E-60, trade name, product of Meisei Chemical Works, Ltd.; molecular weight: 1,000,000 to 1,200,000) was mixed with 0.1% of α-tocopherol, 0.3% of β-tocopherol, 0.1% of γ-tocopherol, 0.3% of δ-tocopherol, 0.3% of DL-alanine, 40.9% of sodium chloride, 10% of tartaric acid and 40% of urea to obtain a first cloth treating agent.

A second cloth treating agent was then prepared by thoroughly mixing 5% of the first cloth treating agent with 95% of water. A polyester cloth was impregnated with the second cloth treating agent at a pickup of 100% and then dried at 100° C. for 1 minute by a pin tenter to obtain a cloth for ink-jet textile printing according to this example. The thus-obtained cloth was cut into sizes of an A4 format, and full-color printing was conducted on the cloth sample thus obtained by means of a commercially available ink-jet color printer (BJC-620, trade name, manufactured by Canon Inc.) using the same inks as those used in Example 1-1.

After completion of the printing, the printed cloth was treated in the same manner as in Example 1-1 to obtain a print. As a result, a color image having deep color and a sufficient color value was brightly printed on the resultant polyester cloth. In addition, the print thus obtained was free of any bleeding of the image even at its portions of large shot-in ink quantity. Further, the first cloth treating agent, the second cloth treating agent and the cloth treated with the second cloth treating agent were respectively stored in the same manner as in Examples 1-2 to 1-4 and evaluated. As a result, no deterioration by the storage was observed in any case.

The above-described results are shown in Table 3.

TABLE 3

| | | Proportion of tocopherol to polyethylene oxide | Evaluation* results |
|---|---|---|---|
| Initial image | Ex. 3-1 | 10% | A |
| Storage stability | Ex. 3-2 | " | A |
| | Ex. 3-3 | " | A |
| | Ex. 3-4 | " | A |

COMPARATIVE EXAMPLES 1-1 to 1-4

Twenty percent (20%) of a polyethylene oxide compound (Alkox E-30, trade name, product of Meisei Chemical Works, Ltd.; molecular weight: 300,000 to 500,000) was mixed with 80% of sodium sulfate to obtain a first cloth treating agent for ink-jet textile printing. Thereafter, the same process as in Example 1-1 was conducted to prepare a comparative polyester cloth.

Full-color printing was conducted on the cloth sample thus obtained by means of a commercially available ink-jet color printer (BJC-820, trade name, manufactured by Canon Inc.) using the same inks as those used in Example 1-1. After completion of the printing, the printed cloth was treated in the same manner as in Example 1-1 to obtain a print.

As a result, a color image having deep color and a sufficient color value was brightly printed on the resultant polyester cloth. In addition, the print thus obtained was free of any bleeding of the image even at its portions of large shot-in ink quantity. When the first cloth treating agent, the second cloth treating agent and the cloth treated with the second cloth treating agent were respectively stored in the same manner as in Examples 1-2 to 1-4 and evaluated, however, no image of the same level as the initial image was able to be obtained, namely, deterioration by the storage was observed in each case.

The above-described results are shown in Table 4.

TABLE 4

| | | Proportion of tocopherol to polyethylene oxide | Evaluation* results |
|---|---|---|---|
| Initial image | Comp. Ex. 1-1 | 0% | A |
| Storage stability | Comp. Ex. 1-2 | " | C |
| | Comp. Ex. 1-3 | " | D |
| | Comp. Ex. 1-4 | " | D |

EXAMPLES 4-1 to 4-4

Twenty percent (20%) of a polyethylene oxide compound (Alkox E-30, trade name, product of Meisei Chemical Works, Ltd.; molecular weight: 300,000 to 500,000) was mixed with 75.8% of sodium sulfate and 4.2% of δ-tocopherol to obtain a first cloth treating agent for ink-jet textile printing. Thereafter, the same process as in Example 1-1 was conducted to prepare a polyester cloth according to this example. Full-color printing was conducted on the cloth sample thus obtained by means of a commercially available ink-jet color printer (BJC-820, trade name, manufactured by Canon Inc.) using the same inks as those used in Example 1-1. After completion of the printing, the printed cloth was treated in the same manner as in Example 1-1 to obtain a print.

As a result, a color image having deep color and a sufficient color value was printed on the resultant polyester cloth. In addition, the print thus obtained was free of any bleeding of the image even at its portions of large shot-in ink quantity. Further, the first cloth treating agent, the second cloth treating agent and the cloth treated with the second cloth treating agent were respectively stored in the same manner as in Examples 1-2 to 1-4 and evaluated. As a result, images of the same level as the initial image were able to be obtained, namely, no deterioration by the storage was observed in any case.

The above-described results are shown in Table 5.

TABLE 5

| | | Proportion of tocopherol to polyethylene oxide | Evaluation* results |
|---|---|---|---|
| Initial image | Ex. 4-1 | 21% | B |
| Storage stability | Ex. 4-2 | " | A |
| | Ex. 4-3 | " | A |
| | Ex. 4-4 | " | A |

In Tables 2 to 5, evaluations were ranked in the same manner as in Example 1-1.

What is claimed is:

1. A textile printing process comprising the steps of:

(i) applying an ink to a cloth comprising a tocopherol and at least one of a polyethylene oxide compound and a derivative thereof having a weight average molecular weight of 100,000–2,000,000 using an ink-jet system;

(ii) subjecting the cloth, to which the ink has been applied, to a coloring treatment; and (iii) washing and drying the cloth resulting from step (ii).

2. The textile printing process according to claim 1, wherein the coloring treatment comprises a step for steaming the cloth.

3. A print produced in accordance with the textile printing process according to claim 1.

* * * * *

UNITED STATES PATENT AND TRADEMARK OFFICE

CERTIFICATE OF CORRECTION

PATENT NO. : 6,613,821 B2
DATED : September 2, 2003
INVENTOR(S) : Mariko Suzuki et al.

It is certified that error appears in the above-identified patent and that said Letters Patent is hereby corrected as shown below:

Title page,
Item [*] Notice, insert -- This patent issued on a continued prosecution application filed under 37 CFR 1.53(d), and is subject to the twenty year patent term provisions of 35 U.S.C. 154(a)(2). --

Column 2,
Line 25, "further" should read -- a further --.

Signed and Sealed this

Twenty-seventh Day of January, 2004

JON W. DUDAS
*Acting Director of the United States Patent and Trademark Office*